US012497256B2

(12) United States Patent
Shi et al.

(10) Patent No.: US 12,497,256 B2
(45) Date of Patent: Dec. 16, 2025

(54) REWIND SYSTEM

(71) Applicant: CONTEMPORARY AMPEREX TECHNOLOGY (HONG KONG) LIMITED, Hong Kong (CN)

(72) Inventors: Qiwen Shi, Ningde (CN); Han Wang, Ningde (CN); Qiancheng Yang, Ningde (CN)

(73) Assignee: CONTEMPORARY AMPEREX TECHNOLOGY (HONG KONG) LIMITED, Hong Kong (CN)

( * ) Notice: Subject to any disclaimer, the term of this patent is extended or adjusted under 35 U.S.C. 154(b) by 259 days.

(21) Appl. No.: 18/333,365

(22) Filed: Jun. 12, 2023

(65) Prior Publication Data

US 2023/0322514 A1 Oct. 12, 2023

Related U.S. Application Data

(63) Continuation of application No. PCT/CN2022/100466, filed on Jun. 22, 2022.

(30) Foreign Application Priority Data

Jul. 29, 2021 (CN) ..... 202121749654.6

(51) Int. Cl.
*B65H 19/28* (2006.01)
*B65H 18/08* (2006.01)

(52) U.S. Cl.
CPC ..... *B65H 19/28* (2013.01); *B65H 18/08* (2013.01); *B65H 2301/4148* (2013.01)

(58) Field of Classification Search
CPC .... B65H 19/28; B65H 19/2215; B65H 18/08; H01M 10/0409
See application file for complete search history.

(56) References Cited

U.S. PATENT DOCUMENTS

| | | | | |
|---|---|---|---|---|
| 10,035,278 | B2 * | 7/2018 | Nomura | B65H 35/02 |
| 2010/0155522 | A1 * | 6/2010 | Arimitsu | B65H 35/02 242/525 |
| 2023/0048065 | A1 * | 2/2023 | Ikeshita | H01M 50/403 |

FOREIGN PATENT DOCUMENTS

| | | |
|---|---|---|
| CN | 109534076 A | 3/2019 |
| CN | 208955105 U | 6/2019 |

(Continued)

OTHER PUBLICATIONS

The World Intellectual Property Organization (WIPO) International Search Report and Written Opinion for PCT/CN2022/100466 Sep. 9, 2022 13 pages (including English translation).

(Continued)

*Primary Examiner* — Sang K Kim
(74) *Attorney, Agent, or Firm* — ANOVA LAW GROUP, PLLC

(57) ABSTRACT

A rewind system includes a conveyor assembly and a rewind apparatus. The conveyor assembly is configured to convey strips along a plurality of paths each configured to convey at least one strip. The rewind apparatus includes a drum and a plurality of shafts. The strip on each path is rewound around one of the shafts. Two adjacent shafts do not take up strips simultaneously. The drum is configured to rotate around an axis of the drum. The drum is configured to switch each of the strips on different paths from one shaft onto another shaft after the drum rotates by a predetermined angle.

13 Claims, 4 Drawing Sheets

(56) References Cited

FOREIGN PATENT DOCUMENTS

| | | | |
|---|---|---|---|
| CN | 215592164 | U | 1/2022 |
| CN | 216004679 | U | 3/2022 |
| DE | 1288400 | B | 1/1969 |
| EP | 2067724 | A1 | 6/2009 |
| FR | 1458315 | A | 3/1966 |
| JP | S63288852 | A | 11/1988 |
| JP | 2000158042 | A | 6/2000 |

OTHER PUBLICATIONS

The European Patent Office (EPO) The Extended European Search Report for Application No. 22848128.9 Aug. 5, 2024 7 Pages.

* cited by examiner

REWIND SYSTEM

CROSS-REFERENCE TO RELATED APPLICATIONS

This application is a continuation of International Application No. PCT/CN2022/100466, filed on Jun. 22, 2022, which claims priority to Chinese Patent Application No. 202121749654.6, filed on Jul. 29, 2021 and entitled "REWIND SYSTEM", which are incorporated herein by reference in their entirety.

TECHNICAL FIELD

This application relates to the technical field of battery manufacturing devices, and in particular, to a rewind system.

BACKGROUND

Tape-like strip materials involved in the manufacture of batteries mainly include a positive electrode plate, a negative electrode plate, and a separator. In practical use, the raw materials of the strip materials need to be cut into desired widths, and the cut-out strips are wound separately. A roll of relatively wide strips is usually cut into a plurality of rolls of narrower strips.

In the related art, the cut-out strips are rewound by using a rewind system. However, a conventional rewind system rewinds only one roll of strips at a time, and is unable to rewind a plurality of strips simultaneously, thereby making the rewinding process inefficient.

SUMMARY

In view of the above problems, an embodiment of this application provides a rewind system to solve the problem of inefficiency of rewinding strips.

An embodiment of this application provides a rewind system. The rewind system includes:

- a conveyor assembly, configured to convey strips along a plurality of paths, each path being capable of conveying at least one strip; and
- a rewind apparatus, including a drum and a plurality of shafts, where the strip on each path is rewound around one of the shafts, two adjacent shafts do not take up strips simultaneously, the drum is able to rotate around an axis of the drum, and the drum is configured to switch each of the strips on different paths from one shaft onto another shaft when the drum rotates by a predetermined angle.

Based on the above technical solution, the conveyor assembly conveys the strips along a plurality of paths, so as to draw out a plurality of strips at a time and rewind the strips on different paths around the shafts simultaneously. Two adjacent shafts do not take up the strips simultaneously. Therefore, during the rotation of the drum around the axis of the drum, a vacant shaft that is upstream in the rotation direction gradually rotates to a take-up position. When the conveyance path of the strip remains unchanged, the strip will switch onto the shaft that is in this take-up position. In this way, the vacant shaft takes up the strip in the position taken over from the original shaft. The shaft that bears the strip rotates to a downstream position in the rotation direction of the drum, and an operator removes the rewound strip from this downstream position to leave a vacant position. The vacant position will replace the shaft at the take-up position during the subsequent rotation. The application enables a plurality of strips to be rewound simultaneously on the rewind apparatus. The rewind system does not need to halt during the switching between shafts, so as to implement continuous rewinding and improve the rewinding efficiency significantly.

In some embodiments, angles between connection planes that connect the axes of any two adjacent shafts and a rotation axis of the drum respectively are equal, so that the strip on each path is able to be switched from one shaft onto an adjacent shaft when the drum rotates by the predetermined angle.

Based on the above technical solution, the predetermined angle may be set to be equal to the degree of the angle. When the shaft rotates by the predetermined angle, each shaft located upstream in the rotation direction can rotate to an angular direction in which a downstream adjacent shaft is located, so as to switch the strip between the adjacent shafts. Moreover, in each process of switching the strip, the angle by which the drum needs to rotate is identical, thereby facilitating the control of the rewind system.

In some embodiments, the plurality of shafts are distributed in a circular array around a rotation center of the drum.

Based on the above technical solution, when the shaft rotates by the predetermined angle, each shaft located upstream in the rotation direction can rotate to an angular direction in which a downstream adjacent shaft is located, and take over a position of the downstream adjacent shaft, so as to take up strips in place of the downstream adjacent shaft and complete one switching process between shafts.

In some embodiments, auxiliary rollers are disposed on the drum, and each of the auxiliary rollers is located between two adjacent shafts in a circumferential direction of the drum, and is configured to support the strip during switching.

Based on the above technical solution, during the switching between the shafts, when a strip on a shaft that is located upstream in the rotation direction of the drum and adjacent to the take-up position remains unremoved, because the strips are supported by an auxiliary roller, the strips continuously conveyed to the take-up position will not immediately sag onto the unremoved strip, and therefore, will not affect the collection of the rewound strips. Second, the auxiliary roller tensions the strip between two adjacent shafts, thereby preventing problems such as wobbling and tilting of the strip caused by an unduly long travel path of the strip between two adjacent shafts. Third, when the strip completes switching between two adjacent shafts, the strip can be cut off under the support of the auxiliary roller, so as to prevent an extrusion force caused by the cutting of the strip from disrupting the rewinding of the strip around the two adjacent shafts.

In some embodiments, each of the auxiliary rollers is disposed on an angular bisector of one of the angles.

Based on the above technical solution, no matter whether the drum rotates clockwise or counterclockwise, the angle between the shaft and the auxiliary roller located upstream in the rotation direction of the drum is identical, so as to achieve the same supporting effect.

In some embodiments, two adjacent auxiliary rollers possess a first common tangent, and the first common tangent is a common tangent that is tangent to the two auxiliary rollers at a side away from a center of the drum.

In the circumferential direction of the drum, the first common tangent intersects the shaft located between the two adjacent auxiliary rollers.

Alternatively, in the circumferential direction of the drum, the shaft located between the two adjacent auxiliary rollers is located on a side that is of the first common tangent and that is away from a rotation center of the drum, so as to ensure the strip to fit snugly with the shaft during switching.

Based on the above technical solution, during the rotation of the drum, after the strip is wound past one auxiliary roller, the strip is necessarily able to be in contact with and fit snugly with a shaft, instead of bypassing the shaft and being directly wound onto another auxiliary roller, thereby ensuring normal switching of the strip between the two adjacent shafts.

In some embodiments, there are a plurality of auxiliary rollers, and distances from axes of the plurality of auxiliary rollers to the axis of the drum are equal.

Based on the above technical solution, the positioning and mounting of the auxiliary roller on the drum are facilitated.

In some embodiments, the conveyor assembly includes an idler roller configured to tension the strip on the path.

Based on the above technical solution, when the conveyance path of the strip is relatively long, the idler rollers are disposed at intervals so that the strip can be wound past an idler roller, thereby preventing the strip from sagging, wobbling, and wrinkling. The direction and area of a close fit between the strip and the idler roller may be adjusted to change the conveyance direction of the strip, thereby controlling the strip to travel along a specified path.

In some embodiments, the rewind apparatus further includes a cleaning assembly configured to clean debris away from a surface of the strip.

Based on the above technical solution, the debris on the surface of the strip is prevented from polluting the strip, and also prevented from piercing and damaging the strip during the winding of the strip.

In some embodiments, the cleaning assembly includes a brush roller, and the strip is in contact with the brush roller during conveyance to clean the debris away from the surface of the strip.

Based on the above technical solution, the brush roller sweeps away the debris on the surface of the strip that passes through the brush roller. Through friction with the surface of the strip, the brush roller can not only sweep away the floating dust, but also brush off sticky debris on the surface of the strip. Due to a soft surface of the brush roller, the brush roller does not hinder conveyance of the strip, nor will it damage the strip.

In embodiments of this application, the conveyor assembly conveys the strips along a plurality of paths, and the strip on each path is wound around one of the shafts on the drum, so as to rewind a plurality of strips simultaneously. This application also enables two adjacent shafts to take up strips non-simultaneously. Therefore, when the drum rotates by a predetermined angle, the strips on different paths can be switched from one shaft onto another shaft separately. During the switching, the rewind system can rewind strips continuously without halting, thereby greatly improving the rewinding efficiency.

The foregoing description is merely an overview of the technical solutions of this application. The following describes specific embodiments of this application illustratively to enable a clearer understanding of the technical solutions of this application, enable implementation of the technical solutions based on the subject-matter hereof, and make the foregoing and other objectives, features, and advantages of this application more evident and comprehensible.

BRIEF DESCRIPTION OF DRAWINGS

To describe the technical solutions in the embodiments of this application more clearly, the following outlines the accompanying drawings used in the embodiments. Apparently, the drawings outlined below are only a part of embodiments of this application. A person of ordinary skill in the art may derive other drawings from such drawings without making any creative efforts.

Figure 1:
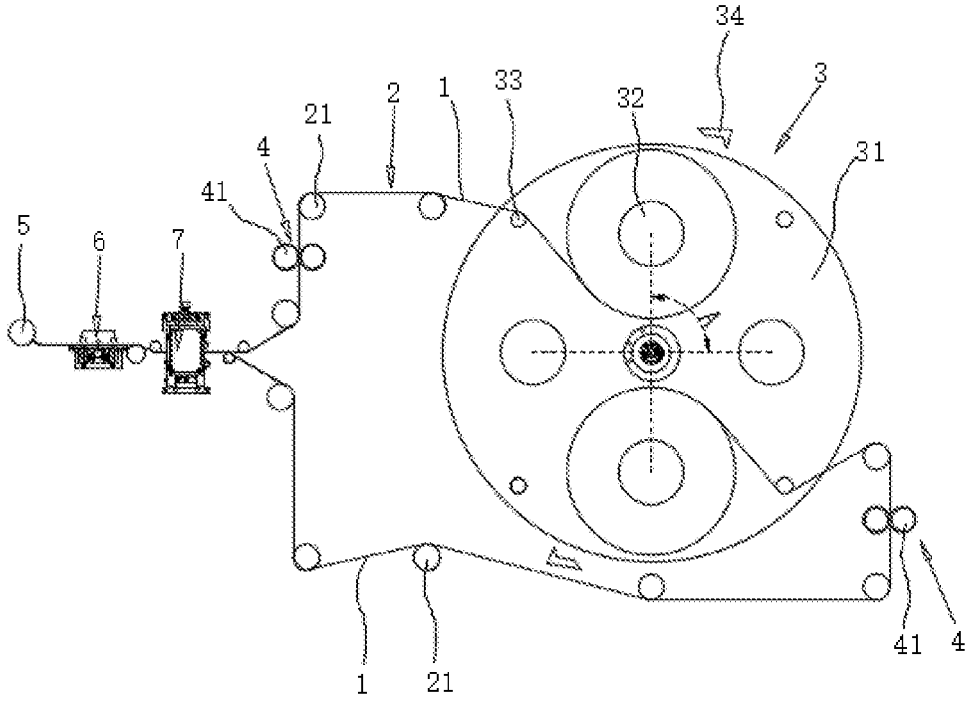
FIG. 1 is a schematic structural diagram of a rewind system in a first state according to an embodiment of this application.

Reference numerals: 1. strip; 2. conveyor assembly; 21. idler roller; 3. rewind apparatus; 31. drum; 32. shaft; 33. auxiliary roller; 34. cutter; 35. first tangent 4. cleaning assembly; 41. brush roller; 5. unwind apparatus; 6. splicing apparatus; 61. support platform; 62. first press plate; 63. second press plate; 7. slitting apparatus.

DETAILED DESCRIPTION OF EMBODIMENTS

To make the objectives, technical solutions, and advantages of the embodiments of this application clearer, the following gives a clear and complete description of the technical solutions in the embodiments of this application with reference to the drawings in the embodiments of this application. Apparently, the described embodiments are merely a part of but not all of the embodiments of this application. All other embodiments derived by a person of ordinary skill in the art based on the embodiments of this application without making any creative efforts shall fall within the protection scope of this application.

Unless otherwise defined, all technical and scientific terms used herein have the same meanings as what is normally understood by a person skilled in the technical field of this application. The terms used in the specification of this application are merely intended to describe specific embodiments but not to limit this application.

The terms "include" and "contain" and any variations thereof used in the specification, claims, and brief description of drawings of this application are intended as non-exclusive inclusion. The word "a" or "an" preceding an item does not exclude the presence of a plurality of items.

Reference to "embodiment" herein means that a specific feature, structure or characteristic described with reference to the embodiment may be included in at least one embodiment of this application. The reference to the term "embodiment" in different places in the specification does not necessarily represent the same embodiment, nor does it represent an independent or alternative embodiment in a mutually exclusive relationship with other embodiments. A person skilled in the art explicitly and implicitly understands that the embodiments described herein may be combined with other embodiments.

The directional terms used in the following description indicate the directions shown in the drawings, but are not intended to limit specific structures of the rewind system in this application. For example, in the description of this application, a direction or a positional relationship indicated by the terms such as "center", "longitudinal", "transverse", "length", "width", "thickness", "up", "down", "before", "after", "left", "right", "vertical", "horizontal", "top", "bottom", "in", "out", "clockwise", "counterclockwise", "axial", "radial", and "circumferential" is a direction or positional relationship based on the illustration in the drawings, and is merely intended for ease or brevity of description of this application, but not intended to indicate or imply that the indicated device or component is necessarily located in the specified direction or constructed or operated in the specified direction. Therefore, such terms are not to be understood as a limitation on this application.

In addition, the terms such as "first" and "second" used in the specification, claims, and brief description of drawings herein are intended to distinguish between different items, but are not intended to describe a specific sequence or order of precedence. A feature preceded by such terms may explicitly or implicitly include one or more of the features.

Unless otherwise specified, in the description of this application, "a plurality of" means two or more (including two). Similarly, "a plurality of groups" means two or more groups (including two groups).

It is hereby noted that, in the description of this application, unless otherwise expressly specified and defined, the terms "mount", "concatenate", and "connect" are understood in a broad sense. For example, a "concatenation" or "connection" of a mechanical structure may be a physical connection. For example, a physical connection may be a fixed connection. Examples of the fixed connection include a fixed connection implemented by using a fastener, and a fixed connection implemented by using a screw, a bolt, or other fasteners. A physical connection may be a detachable connection, for example, a snap-fit connection or snap-fastening. A physical connection may be an integrated connection, for example, welding, bonding, or one-piece shaped connection.

Tape-like strip materials involved in the manufacture of batteries mainly include a positive electrode plate, a negative electrode plate, and a separator. The tape-like materials are usually long and wide upon delivery into the factory in whole rolls, and are hereinafter referred to as raw strips. A raw strip in use needs to be cut into the desired width and length according to the needs of different batteries. In a process of cutting the raw strip into narrow strips, the cut-out strips need to be rewound separately. A roll of raw strip is usually cut into a plurality of rolls of narrower strips.

In the related art, the cut-out strips are rewound by using a rewind system. However, a conventional rewind system rewinds only one roll of strips at a time, and is unable to rewind a plurality of strips simultaneously. Even if a plurality of strips can be rewound simultaneously, the rewind system has to be halted to switch the strips between shafts, and the rewinding operations cannot be carried out continuously, thereby making the rewinding process inefficient.

For this reason, in other existing technologies, a plurality of rewind devices are configured to rewind the cut-out strips separately. This method causes the entire rewind system to occupy a large area, thereby not only wasting the cost of the premises, but also making personnel operate back and forth between a plurality of rewind apparatuses, and resulting in inconvenience of operation.

Figure 2:
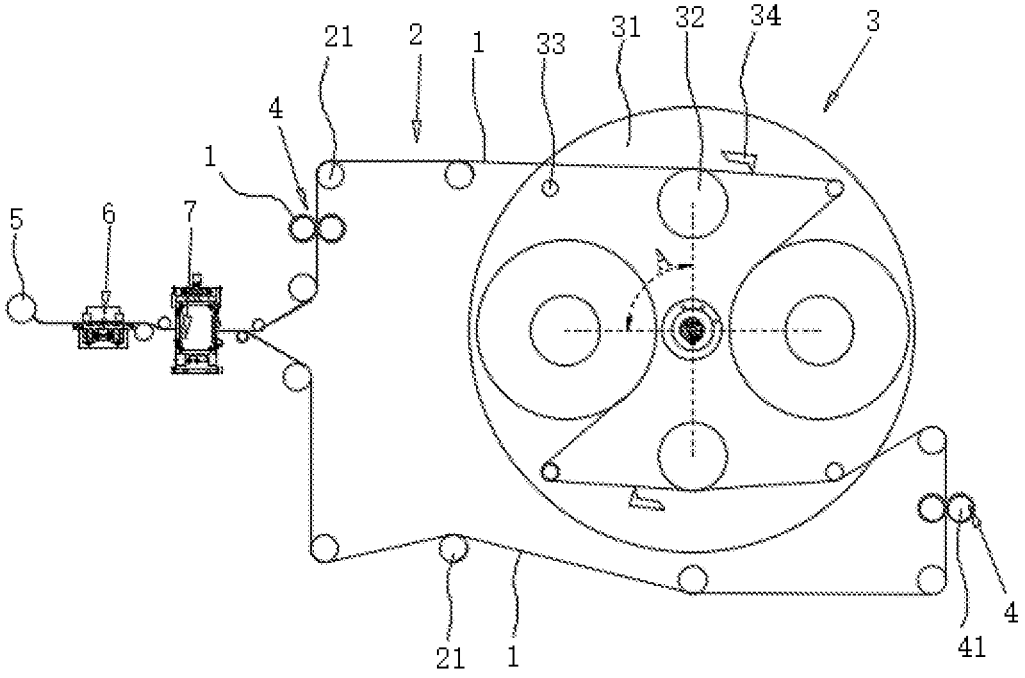
FIG. 2 is schematic structural diagram of the rewind system shown in FIG. 1 in a second state.

In view of the factors above, as shown in FIG. 1 and FIG. 2, an embodiment of this application provides a rewind system. The rewind system includes: a conveyor assembly 2 and a rewind apparatus 3.

The conveyor assembly 2 is configured to convey strips 1 along a plurality of paths, each path being capable of conveying at least one strip 1.

The rewind apparatus 3 includes a drum 31 and a plurality of shafts 32. The strip 1 on each path is rewound around one of the shafts 32. Two adjacent shafts 32 do not take up strips simultaneously. The drum 31 is able to rotate around an axis of the drum. The drum 31 is configured to switch each of the strips 1 on different paths from one shaft 32 onto another shaft 32 when the drum rotates by a predetermined angle.

Figure 3:
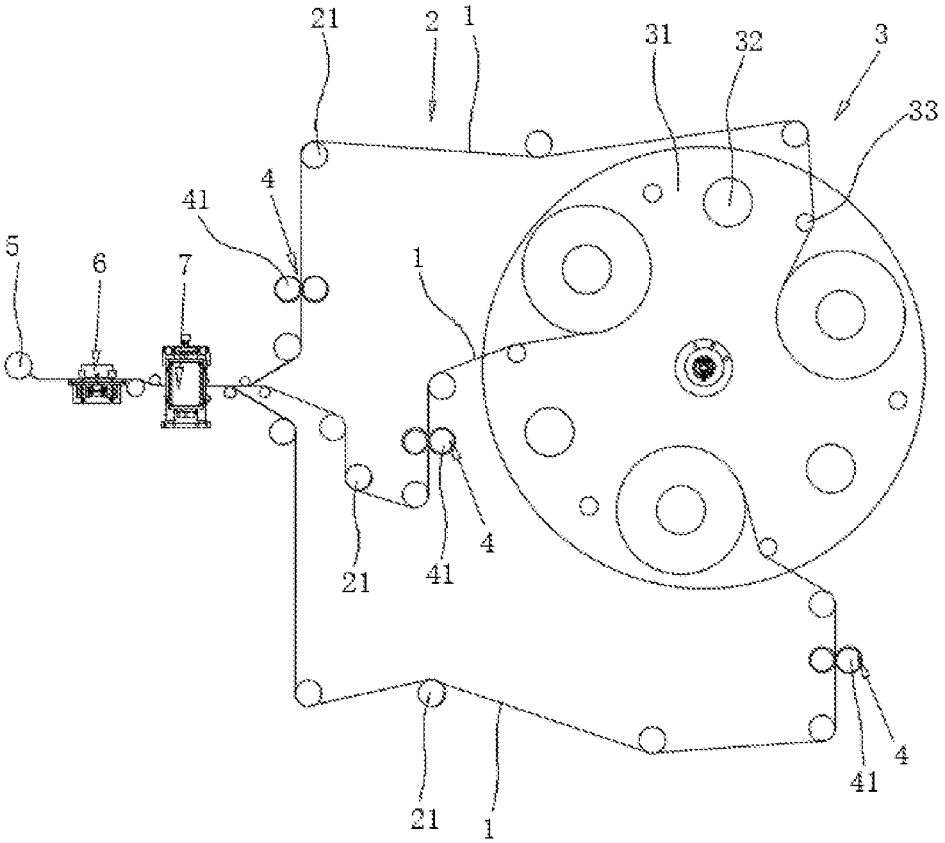
FIG. 3 is a schematic structural diagram of a rewind apparatus according to an embodiment of this application.

Both FIG. 1 and FIG. 2 use four shafts 32 as an example. FIG. 1 is a schematic diagram of a rewind apparatus 3 in a first state, and FIG. 2 is schematic diagram of the rewind apparatus 3 in a second state. Definitely, there may be more shafts 32 on the same drum 31. For example, as shown in FIG. 3, FIG. 3 is a schematic diagram of a first state of a rewind apparatus 3 that includes 6 shafts 32. The number of shafts 32 that take up strips simultaneously on the drum 31 is not necessarily two or three, and may be other numbers, as long as it is ensured that two adjacent shafts 32 do not take up strips simultaneously.

Figure 4:
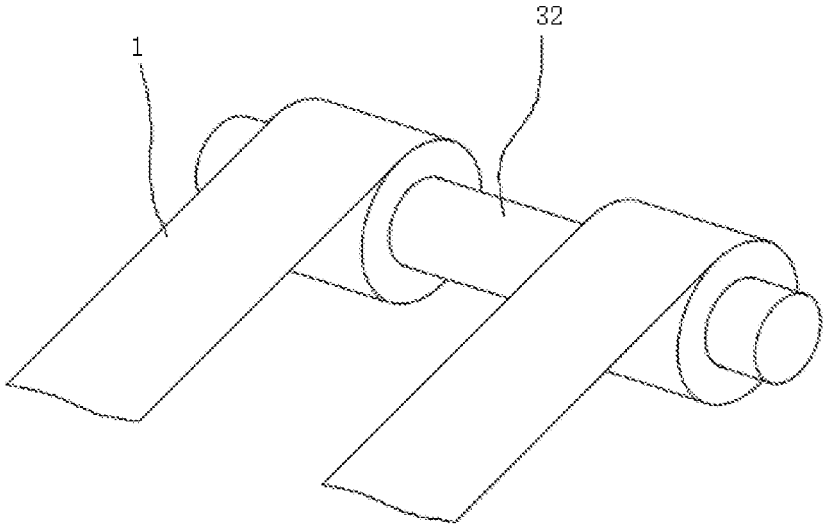
FIG. 4 is a schematic diagram of a plurality of strips wound around the same shaft in parallel.

The number of strips 1 conveyed on different paths may be the same or different. As shown in FIG. 4, it is hereby noted that, when a plurality of strips 1 are simultaneously conveyed on one path, the plurality of strips 1 are arranged alongside, and are simultaneously conveyed to one of the shafts 32 along the path, and are finally rewound around this shaft 32 alongside. That is, the plurality of strips 1 are rewound at different positions of the same shaft 32 respectively.

It is hereby noted that, the strip 1 is usually not directly wound on the outer wall of the shaft 32. The shaft 32 is sheathed in a reel. The strip 1 is wound on the outer wall of the reel. The reel rotates together with the shaft 32 to implement the rewinding of the strip 1. The reel together with the strip 1 is removed from the shaft 32 upon completion of the rewinding.

It is hereby noted that the distribution of the plurality of shafts 32 on the drum 31 may be on one distribution circle, or on different distribution circles. That is, the distances from the axes of the plurality of shafts 32 to the rotation axis of the drum 31 may be equal or unequal.

During the rotation of the drum 31, the angles A between connection planes that connect the axes of two adjacent shafts 32 and the rotation axis of the drum 31 respectively may be identical or different. When the angles A are different, the angle by which the drum 31 needs to rotate to implement switching of the strip 1 between the two adjacent shafts 32 is different. When a plurality of shafts 32 on the drum 31 take up strips simultaneously, the predetermined angle by which the drum 31 rotates means an angle by which the drum needs to rotate to successfully switch all the strips 1 on the plurality of shafts 32 from one shaft 32 to another shaft 32. For example, the degree of the predetermined angle may be equal to or greater than the degree of the largest angle A among the plurality of angles A.

Based on the above technical solution, two adjacent shafts 32 do not take up the strips simultaneously. Therefore, during the rotation of the drum 31 around the axis of the drum, a vacant shaft 32 that is upstream in the rotation direction of the drum 31 gradually rotates to a take-up position. On the premise that the conveyance path of the strip 1 in this application remains unchanged, the take-up position remains unchanged. The strip 1 will switch onto the shaft 32 in this take-up position. In this way, the vacant shaft 32 takes up strips in the position taken over from the original shaft 32. The shaft 32 that bears the strip 1 rotates to a position occupied by a downstream shaft 32. Near the position occupied by the downstream shaft 32, an operator removes the rewound strip 1 from this position to vacate the shaft 32, so that the vacant shaft can replace the shaft 32 located at the take-up position during the subsequent rotation.

The take-up position means a position ready for the strip to fit snugly onto any shaft 32 that rotates to this position, so that the shaft 32 can continue taking up strips while rotating. The take-up position is a general orientation relative to the axis of the drum 31, and does not mean any characteristic position on the drum 31.

An upstream shaft 32 means a shaft 32 located at a rear position in the rotation direction of the drum 31 and adjacent to the shaft 32 that bears the strip 1. A downstream shaft 32 means a shaft 32 located at a front position in the rotation direction of the drum and adjacent to the shaft 32 that bears the strip 1. Both the upstream shaft 32 and the downstream shaft 32 are relative concepts with reference to the shaft that bears the strip 1.

This embodiment of this application enables a plurality of strips 1 to be rewound simultaneously on the rewind apparatus 3. The rewind system does not need to halt during the switching between shafts 32, so as to implement continuous rewinding and improve the rewinding efficiency significantly.

In addition, this embodiment of this application implements continuous rewinding of a plurality of strips 1 simultaneously by using just one rewind apparatus 3, thereby reducing the area that needs to be occupied by the device, reducing the labor intensity of operators operating back and forth between different devices, and facilitating use.

In some embodiments, the shaft 32 is a differential shaft. The inner wall of the reel is squeezed by controlling local expansion of the differential shaft, so that the reel is fixed onto the differential shaft to facilitate constant-tension rewinding. To remove the reel, the reel is relaxed through partial retraction of the differential shaft, so that the reel can be removed together with the strip 1. In some embodiments, angles A between connection planes that connect the axes of any two adjacent shafts 32 and a rotation axis of the drum 31 respectively are equal, so that the strip 1 on each path is able to be switched from one shaft 32 onto an adjacent shaft 32 when the drum 31 rotates by the predetermined angle.

Based on the above technical solution, the predetermined angle may be set to be equal to the degree of the angle A. When the shaft 32 rotates by the predetermined angle, each shaft 32 located upstream in the rotation direction can rotate to an angular direction in which a downstream adjacent shaft 32 is located, so as to switch the strip 1 between the adjacent shafts 32. Moreover, in each process of switching the strip 1, the angle by which the drum 31 needs to rotate is identical, thereby facilitating the control of the rewind system.

In some embodiments, the plurality of shafts 32 are distributed in a circular array around a rotation center of the drum 31. To be specific, the angles A between connection planes that connect the axes of any two adjacent shafts 32 and the rotation axis of the drum 31 respectively are equal; the plurality of shafts 32 are located on the same distribution circle around the rotation axis of the drum 31; and the distances between two adjacent shafts 32 are equal.

Based on the above technical solution, when the shaft 32 rotates by the predetermined angle, each shaft 32 located upstream in the rotation direction can simultaneously rotate to an angular direction in which a downstream adjacent shaft 32 is located, and take over a position of the downstream adjacent shaft 32, so as to take up strips in place of the downstream adjacent shaft and complete one switching process between shafts 32. During each switching process, there is one vacant shaft 32 that rotates to and takes over the position of the shaft 32 that has completed rewinding, and the shaft 32 that has completed rewinding vacates this position. Therefore, the strip 1 can be switched between different shafts 32 without a need to adjust the conveyance path. In addition, in this technical solution, the distances between the plurality of shafts 32 are equal. Therefore, a maximum winding diameter for each shaft 32 to take up the strip 1 is identical, thereby facilitating standardized production.

During the switching between the shafts 32, when the strip 1 that has been rewound around the shaft 32 located upstream in the rotation direction of the drum 31 and adjacent to the take-up position remains unremoved, it is necessary to restrict the strip 1 between the two adjacent shafts 32 from sagging, and prevent the strip 1 from entangling the rewound strip 1, because the entangling will affect the rewinding quality and hinder the removal of the strip.

In order to meet the above production requirements, as shown in FIG. 1, FIG. 2, FIG. 3, and FIG. 5, in some embodiments, auxiliary rollers 33 are disposed on the drum 31. Each of the auxiliary rollers 33 is located between two adjacent shafts 32 in a circumferential direction of the drum 31, and is configured to support the strip 1 during switching.

Figure 5:
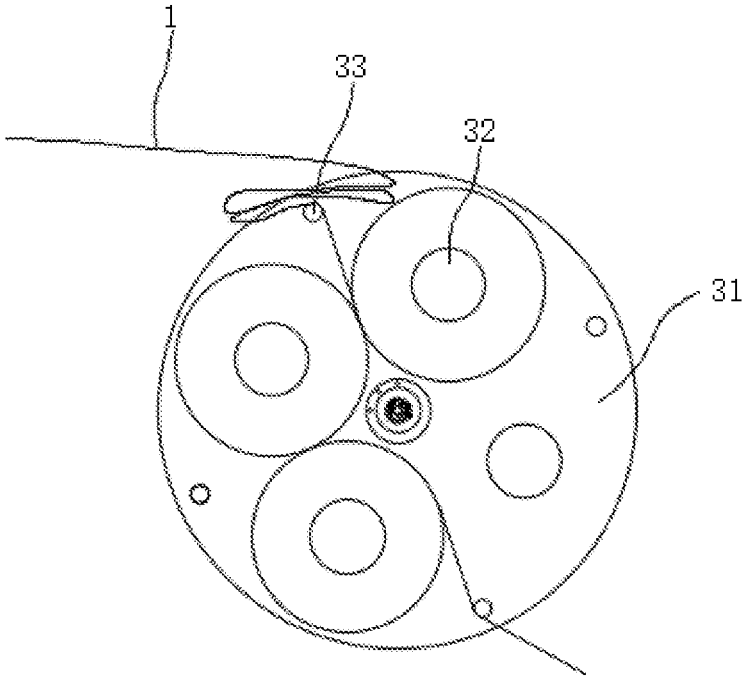
FIG. 5 is a schematic diagram of a state of an auxiliary roller supporting a strip during switching between shafts.

As shown in FIG. 5, under the support of the auxiliary roller 33, the strip 1 between two adjacent shafts 32 will not sag onto the rewound strip 1 as soon as the above situation occurs, so as not to affect the collection of the rewound strip 1. Second, the auxiliary roller 33 tensions the strip 1 between two adjacent shafts 32, thereby preventing the strip 1 from the problems such as wobbling and tilting of the strip 1 caused by an unduly long travel path between two adjacent shafts 32. Third, when the strip 1 completes switching between two adjacent shafts 32, the strip 1 can be cut off under the support of the auxiliary roller 33, so as to prevent an extrusion force caused by the cutting of the strip 1 from disrupting the rewinding of the strip 1 around the two adjacent shafts 32.

In some embodiments, each of the auxiliary rollers 33 is disposed on an angular bisector of one of the angles A.

Based on the above technical solution, no matter whether the drum 31 rotates clockwise or counterclockwise, the angle A between the shaft 32 and the auxiliary roller 33 located upstream in the rotation direction of the drum 31 is identical, so as to achieve the same supporting effect at the same position.

Figure 6:
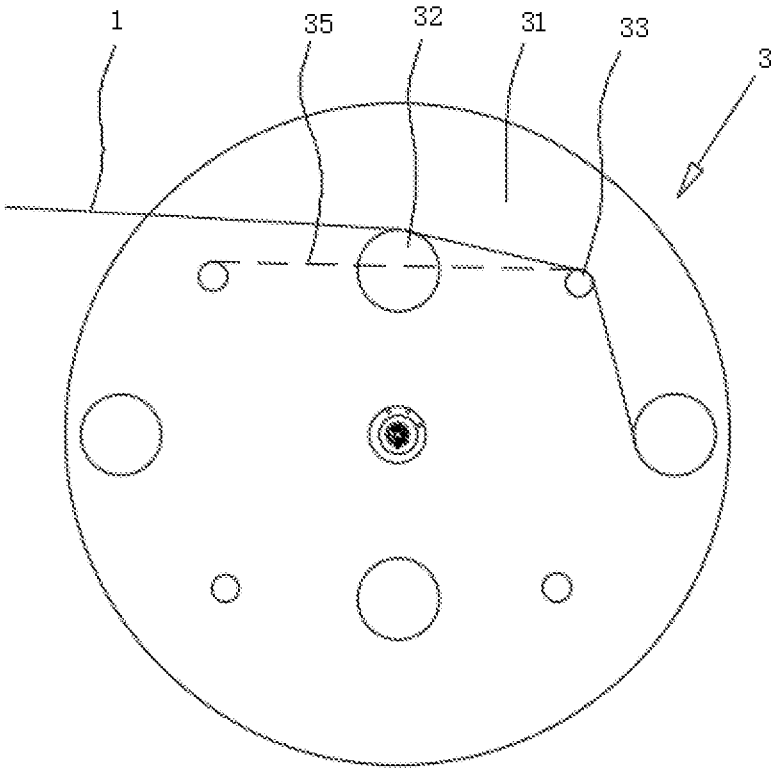
FIG. 6 is a schematic structural diagram of a rewind apparatus according to another embodiment of this application.
Figure 7:
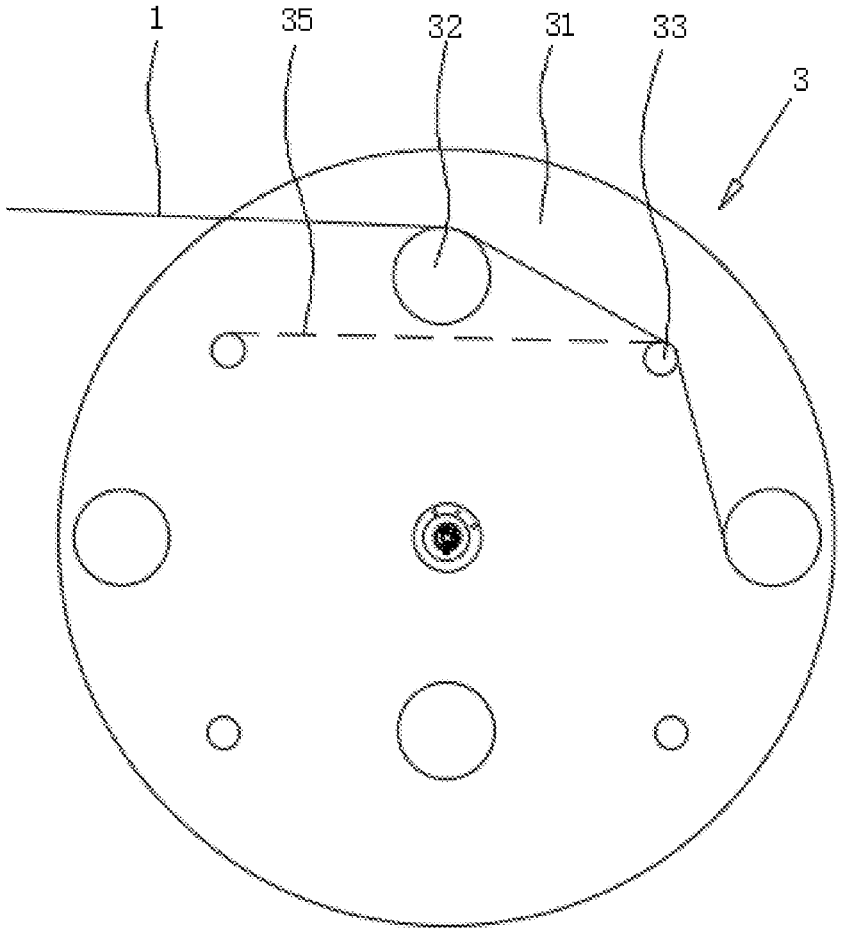
FIG. 7 is a schematic structural diagram of a rewind apparatus according to still another embodiment of this application.

As shown in FIG. 6 and FIG. 7, in some embodiments, two adjacent auxiliary rollers 33 possess a first common tangent 35. The first common tangent 35 is a common tangent that is tangent to the two auxiliary rollers 33 at a side away from a center of the drum 31.

As shown in FIG. 6, in the circumferential direction of the drum 31, the first common tangent intersects the shaft 32 located between the two adjacent auxiliary rollers 33.

Alternatively, as shown in FIG. 7, in the circumferential direction of the drum 31, the shaft 32 located between the two adjacent auxiliary rollers 33 is located on a side that is of the first common tangent and that is away from a rotation center of the drum 31.

The foregoing technical solution can ensure the strip 1 to fit snugly with the shaft 32 smoothly during switching between the shafts 32. To be specific, during the rotation of the drum 31, after the strip 1 is wound past one auxiliary roller 33, the strip is necessarily able to be in contact with and fit snugly with a shaft 32 located upstream in the rotation direction of the drum 31 and adjacent to said auxiliary roller 33, instead of bypassing the shaft 32 and being directly wound onto another auxiliary roller 33, thereby ensuring smooth switching of the strip 1 between the two adjacent shafts 32.

In some embodiments, there are a plurality of auxiliary rollers 33. Distances from axes of the plurality of auxiliary rollers 33 to the axis of the drum 31 are equal, thereby facilitating positioning and mounting of the auxiliary roller 33 on the drum 31.

As shown in FIG. 1 and FIG. 2, in some embodiments, the rewind system further includes a cutter 34. The cutter 34 is configured to cut off the strip 1 after the strip 1 is switched between the shafts 32. The cutter 34 may be disposed in various ways.

As shown in FIG. 1 and FIG. 2, in some embodiments, the cutter 34 is disposed at a specified position outside the drum 31, and the cutter 34 does not rotate along with the drum 31. When the strip 1 completes a process of switching between the shafts 32, the cutter 34 stretches out toward the drum 31. During the stretching, a blade of the cutter contacts and cuts off the strip 1, so that the two rolls of strips are separated from each other, and then the cutter 34 is retracted. A component that drives the cutter 34 to stretch may be an air cylinder, a hydraulic cylinder, a motor, or the like, without being limited in this embodiment of this application.

In some embodiments, the cutter 34 may be disposed on the drum 31 instead, and can rotate along with the drum 31. When the strip 1 completes a process of switching between the shafts 32, the cutter 34 stretches out toward the drum 31. During the stretching, the blade contacts and cuts off the strip 1, so that the two rolls of strips are separated from each other, and then the cutter 34 is retracted. It is hereby noted that, in this embodiment, the cutter 34 needs to be disposed between every two adjacent shafts 32, so that the strip 1 can be cut off when being switched between any two shafts 32.

In some embodiments, the conveyor assembly 2 includes an idler roller 21. The idler roller 21 is configured to tension the strip 1 on the path. As an example, the idler roller 21 is cylindrical. When the conveyance path of the strip 1 is relatively long, the idler rollers 21 are disposed at intervals so that the strip 1 is tensioned when the strip 1 is wound past an idler roller 21, thereby preventing the strip 1 from sagging, wobbling, and wrinkling. In addition, the direction and area of a close fit between the strip 1 and the idler roller 21 may be adjusted to change the conveyance direction of the strip 1, thereby controlling the strip 1 to travel along a specified path.

In this embodiment of this application, the number of the idler rollers 21 is not limited. There may be a plurality of idler rollers 21 on the same path. Each idler roller 21 may be located on any side of the strip 1, without being limited in this application.

In some embodiments, a surface layer of the idler roller 21 is a rubber layer, so as to prevent the strip 1 from slipping on the idler roller 21 and also prevent damage to the surface of the strip 1 during conveyance.

In some embodiments, the idler roller 21 rotates as driven by a drive apparatus, and is configured to convey the strip 1 while supporting the strip 1. The drive apparatus may include, but without being limited to, an electric motor, a chain drive apparatus, a conveyor drive apparatus, and a gear drive apparatus.

Debris may stick to the surface of the raw strip 1, and may pierce the separator when inside the battery and may result in insulation failure, internal short circuits of the battery, and other hazards. Therefore, the surface of the strip 1 needs to be cleaned up during the rewinding.

To meet such requirements, as shown in FIG. 1, FIG. 2, and FIG. 3, in some embodiments, the rewind apparatus 3 further includes a cleaning assembly 4 configured to clean debris away from a surface of the strip 1.

In some embodiments, the cleaning assembly 4 includes a brush roller 41, and the strip 1 is in contact with the brush roller 41 during conveyance to clean the debris away from the surface of the strip 1. As an example, the brush roller 41 includes a cylindrical core and bristles connected to the cylindrical surface of the core. The strip 1 contacts the bristles of the brush roller 41 during conveyance, thereby not only brushing off the dust on the surface of the strip 1, but also brushing off the debris that slightly sticks to the surface of the strip 1.

Similarly, the brush roller 41 may rotate as driven by any drive apparatus, so as to clean the strip 1 during the rotation. Definitely, in some embodiments, the brush roller may not rotate. When the strip 1 passes through the bristles, the debris on the surface of the strip 1 is removed by friction with the bristles.

Based on the above technical solution, the debris on the surface of the strip 1 is prevented from polluting the strip 1 or even piercing the strip 1 and damaging the strip 1.

In some embodiments, in order to clean both surfaces of the strip 1 in the thickness direction, at least two brush rollers 41 are disposed on two sides of the strip 1 in the thickness direction respectively.

In addition, in order to facilitate the removed debris to fall off, the brush assembly 4 is disposed on a relatively upright path travelled by the strip 1, where "relatively upright" means that the strip 1 travelling this path intersects the horizontal plane.

As shown in FIG. 1 and FIG. 2, in some embodiments, the rewind system further includes an unwind apparatus 5, a splicing apparatus 6, and a slitting apparatus 7. The unwind apparatus 5 is configured to supply the raw strip. The splicing apparatus 6 is configured to splice the end of one roll of raw strip to the head of another roll of raw strip, so that the strip 1 is continuously conveyed on the path. The cutting apparatus 7 is configured to cut off the raw strip along a conveyance direction of the raw strip.

In some embodiments, the splicing apparatus 6 is disposed between the unwind apparatus 5 and the cutting apparatus 7. The raw strip that is supplied by the unwind apparatus 5 passes through the splicing apparatus 6 first and then passes through the cutting apparatus 7. When the raw strip passes through the splicing apparatus 6, the raw strip is in an uncut state. The operation of splicing is just to align the end of one raw strip with the head of another raw strip and splice at one time. The operation is convenient, and makes it easy to control the quality of splicing.

Figure 8:
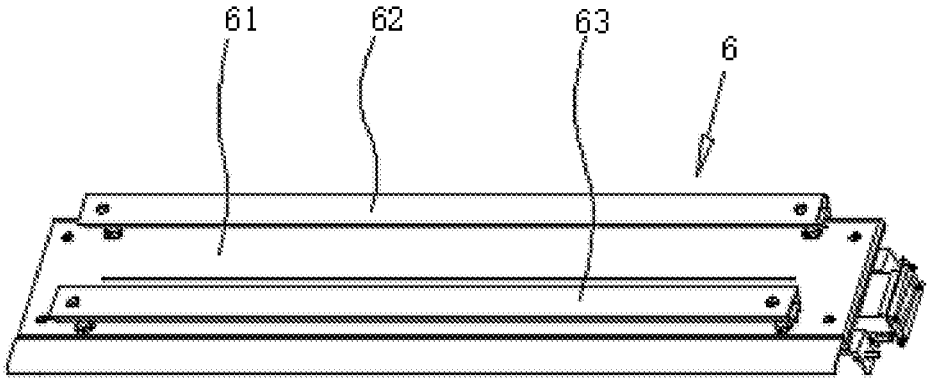
FIG. 8 is a schematic structural diagram of a splicing apparatus according to an embodiment of this application.

As shown in FIG. 8, in some embodiments, the splicing apparatus 6 includes a support platform 61, and a first press plate 62 and a second press plate 63 that are located above the support platform 61. A clearance available for passage of the raw strip exists between the support platform 61 and each of the first press plate 62 and the second press plate 63. A space available for sticking two raw strips exists between the first press plate 62 and the second press plate 63. The first press plate 62 is configured to press the end of a roll of raw strip onto the support platform 61, and the second press plate 63 is configured to press the head of another roll of raw strip onto the support platform 61.

After the end of a roll of raw strip passes through the second press plate 63, the first press plate 62 presses down to fix the end of the raw strip. Subsequently, the head of another roll of raw strip is put under the second press plate 63, and runs through the second press plate 63, so that the head of the raw strip and the end of the previous roll of raw strip at least partly overlap. Subsequently, the second press plate 63 is controlled to press down to fix the head of the raw strip. Finally, the two layers of raw strips are connected by glue or adhesive tape. After the raw strips are connected, the first press plate 62 and the second press plate 63 are controlled to be away from the support platform 61, and the rewind system continues unwinding and rewinding normally.

In some embodiments, the slitting apparatus 7 includes slitting blades arranged side by side along a width direction of the strip. When passing through the slitting blade, the raw strip is divided by the slitting blade into at least two narrow strips 1 of a predetermined width, ready to be rewound separately in subsequent steps.

To sum up, in the rewind system described above, the conveyor assembly 2 conveys the strips 1 along a plurality of paths, and the strip 1 on each path is wound around one of the shafts 32 on the drum 31, so as to rewind a plurality of strips 1 simultaneously. This application also enables two adjacent shafts 32 to take up strips non-simultaneously. Therefore, when the drum 31 rotates by a predetermined angle, the strips 1 on different paths can be switched from one shaft 32 onto another shaft 32 separately. During the switching, the rewind system can rewind strips continuously without halting, thereby greatly improving the rewinding efficiency while implementing continuous rewinding.

A person skilled in the art understands that a combination of features of different embodiments is intended to fall within the scope of this application and form a different embodiment. For example, any one of the embodiments claimed to be protected under the claims may be used in any combination.

The foregoing embodiments are merely intended to describe the technical solutions of this application but not to limit this application. Although this application has been described in detail with reference to the foregoing embodiments, a person of ordinary skill in the art understands that modifications may still be made to the technical solutions described in the foregoing embodiments, or equivalent replacements may still be made to some technical features in the technical solutions. Such modifications and replacements do not make the essence of the corresponding technical solutions depart from the spirit and scope of the technical solutions of the embodiments of this application.

What is claimed is:

1. A rewind system, comprising:

a conveyor assembly, configured to convey strips along a plurality of paths, each path being configured to convey at least one of the strips; and a rewind apparatus, comprising a drum and a plurality of shafts, wherein;

the strip on each path is rewound around one of the shafts;

the plurality of shafts are configured such that any two adjacent shafts do not take up strips simultaneously and, when one shaft is in a strip take-up position, an adjacent shaft adjacent to the one shaft is positioned for strip removal or remains vacant; and the drum is configured to rotate around an axis of the drum and, after rotating by a predetermined angle, switch each of the strips from one shaft onto another shaft.

2. The rewind system according to claim 1, wherein the plurality of shafts are distributed in a circular array around a rotation center of the drum.

3. The rewind system according to claim 1, wherein angles between connection planes that connect axes of any two adjacent shafts and the axis of the drum are equal, so that the strip on each path is able to be switched from one shaft onto an adjacent shaft when the drum rotates by the predetermined angle.

4. The rewind system according to claim 3, wherein an auxiliary roller is disposed on the drum, and the auxiliary roller is located between two adjacent shafts in a circumferential direction of the drum, and is configured to support the strip during switching.

5. The rewind system according to claim 4, wherein the auxiliary rollers is disposed on an angular bisector of one of the angles.

6. The rewind system according to claim 4, wherein the auxiliary roller is one of two adjacent auxiliary rollers that possess a common tangent, and the common tangent is tangent to the two auxiliary rollers at a side away from a center of the drum.

7. The rewind system according to claim 6, wherein in the circumferential direction of the drum, the common tangent intersects the shaft located between the two adjacent auxiliary rollers.

8. The rewind system according to claim 6, wherein in the circumferential direction of the drum, the shaft located between the two adjacent auxiliary rollers is located on a side that is of the common tangent and that is away from a rotation center of the drum, so as to ensure the strip to fit snugly with the shaft during switching.

9. The rewind system according to claim 4, wherein the auxiliary roller is one of a plurality of auxiliary rollers, and distances from axes of the plurality of auxiliary rollers to the axis of the drum are equal.

10. The rewind system according to claim 1, wherein the conveyor assembly comprises an idler roller configured to tension the strip on the path.

11. The rewind system according to claim 1, wherein the rewind apparatus further comprises a cleaning assembly configured to clean debris away from a surface of the strip.

12. The rewind system according to claim 11, wherein the cleaning assembly comprises a brush roller, and the strip is in contact with the brush roller during conveyance to clean the debris away from the surface of the strip.

13. A rewind system, comprising:

a conveyor assembly, configured to convey strips along a plurality of paths, each path being configured to convey at least one of the strips; and a rewind apparatus, comprising:

a drum and a plurality of shafts, wherein the strip on each path is rewound around one of the shafts, two adjacent shafts do not take up strips simultaneously, the drum is configured to rotate around an axis of the drum, and the drum is configured to, after rotating by a predetermined angle, switch each of the strips from one shaft onto another shaft; and a cleaning assembly configured to clean debris away from a surface of the strip.

* * * * *